US006871887B2

(12) United States Patent
Jooss et al.

(10) Patent No.: US 6,871,887 B2
(45) Date of Patent: Mar. 29, 2005

(54) OUTSIDE DOOR HANDLE, IN PARTICULAR FOR MOTOR VEHICLES

(75) Inventors: Juergen Jooss, Sindelfingen (DE); Rudi Koelle, Sindelfingen (DE); Martin Lindmayer, Sulz (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/183,134

(22) Filed: Jun. 26, 2002

(65) Prior Publication Data

US 2003/0001396 A1 Jan. 2, 2003

(30) Foreign Application Priority Data

Jun. 29, 2001 (DE) ..... 101 31 436

(51) Int. Cl.[7] ..... E05B 3/00

(52) U.S. Cl. ..... 292/336.3; 292/347; 292/348; 292/DIG. 65

(58) Field of Search ..... 292/336.3, DIG. 65, 292/347, 348

(56) References Cited

U.S. PATENT DOCUMENTS

| | | | | |
|---|---|---|---|---|
| 5,682,135 | A | * 10/1997 | Labonde | 340/426.17 |
| 5,793,881 | A | * 8/1998 | Stiver et al. | 382/115 |
| 6,002,341 | A | * 12/1999 | Ohta et al. | 340/5.62 |
| 6,072,403 | A | * 6/2000 | Iwasaki et al. | 340/5.72 |
| 6,527,316 | B1 | * 3/2003 | Agostini et al. | 292/347 |

FOREIGN PATENT DOCUMENTS

| | | |
|---|---|---|
| DE | 3931472 | * 4/1991 |
| DE | 4212291 | * 10/1993 |
| DE | 4435894 | * 4/1996 |
| DE | 196 17 038 | 11/1997 |
| DE | 196 33 894 | 2/1998 |
| DE | 197 52 974 | 9/1998 |
| DE | 197 50 023 | 5/1999 |
| DE | 198 16 603 | 8/1999 |
| DE | 198 24 427 | 11/1999 |
| DE | 198 56 902 | 6/2000 |
| DE | 199 43 986 | 3/2001 |
| JP | 10308149 | * 11/1998 |

* cited by examiner

*Primary Examiner*—John B. Walsh
*Assistant Examiner*—Carlos Lugo
(74) *Attorney, Agent, or Firm*—Kenyon & Kenyon

(57) ABSTRACT

An outside door handle includes a handle and a switching component which is coupled to the handle in such a manner that, when there is an opening force which acts in a correct manner on the handle in order to open it, the switching component automatically responds and generates a switching signal. Operating convenience may be achieved by a response threshold of the switching component selected to be at such a low level that the switching component responds even before the opening force overcomes a restoring force counteracting it and prestressing the handle into an unactuated starting position.

3 Claims, 2 Drawing Sheets

OUTSIDE DOOR HANDLE, IN PARTICULAR FOR MOTOR VEHICLES

FIELD OF THE INVENTION

The invention relates to an outside door handle, in particular for a motor vehicle.

BACKGROUND INFORMATION

An outside door handle is described, for example, in German Published Patent Application No. 197 52 974 which has a handle that is designed as a pivoting flap and is mounted in the region of a recessed grip such that it can pivot about an essentially horizontal pivot axis. The outside door handle also has a switching component which is accommodated in the interior of the door and is coupled to the handle. This coupling is undertaken by an actuating contour which is formed on the handle and interacts with a switching rod of the switching component. This coupling enables an opening force which acts in a correct manner on the handle in order to open it to automatically bring about a response of the switching component, with the result that the latter can generate a corresponding switching signal.

In the case of this outside door handle, the switching signal generated by the switching component is used for an access authorization system in order to initiate an identification process with which it is to be established whether the person actuating the handle has or does not have access authorization. If the access authorization is established positively, the respective door lock can be unlocked with the aid of a corresponding actuating drive.

German Published Patent Application No. 198 24 427 describes a further outside door handle, the handle of which interacts in its pivoting positions with switches. This means that the handle has to be pivoted from a starting position into a lower or an upper switching position in order to actuate an upper or lower switch. The switches are also used here for initiating an identification process with which the access authorization of the person actuating the handle can be established.

German Published Patent Application No. 196 17 038 describes a door outside handle which is provided with a capacitive sensor. In this case, an electrode of the capacitive sensor is integrated in the handle of the door outside handle while a second electrode of the capacitive sensor is formed on the door, in the region of the handle, as a component of the door-panel construction, in particular as a recessed grip. An electric field is built up between these electrodes of the capacitive sensor. As soon as a hand penetrates into the gap between the handle and door panel, i.e., into the electric field built up between the electrodes, the capacitance of the field changes, which is sensed by the capacitive sensor, with the result that the latter then generates a corresponding switching signal. Accordingly, the switching component designed as a capacitive sensor responds irrespective of whether opening forces are or are not introduced into the handle. The switching signal of the switching component initiates an identification process which is intended to establish the access authorization of the person whose hand is engaging in the gap between the handle and recessed grip. When there is a positive result, the door lock is released.

German Published Patent Application No. 196 33 894 describes an outside door handle with a switching component integrated into its handle, on an outer side facing away from a recessed grip. If this switching component, which can be designed, for example, as a proximity switch, is actuated, switching signals are generated without an opening force having to be introduced into the handle for this purpose.

German Published Patent Application No. 198 56 902 describes a further outside door handle with a push-button switch integrated into an outer side, which faces away from a recessed grip. Pressure actuation of this push-button switch triggers a corresponding switching signal. In this case too, the push-button switch can be actuated independently of an opening force acting on the handle.

German Published Patent Application No. 198 16 603 describes an outside door handle, the handle of which is coupled to an activating switch in such a manner that the activating switch is activated if the handle leaves its starting position. In this case, the activating switch delivers a control signal to an identification control unit. The control signal of the activating switch is also used here for initiating an identification process in which a question-answer dialogue is used to check the authorization for unlocking the vehicle door. If authorization is absent, the handle can only be moved within a first section sufficient for actuating the activating switch. If an access authorization is positively established, a blocking element is released, as a result of which the handle can be pivoted in a second section extending beyond the first section. If there is a pivoting actuation in the second section, the handle actuates a command switch which generates a control signal causing the electronics of the lock to open the lock using a lock motor.

German Published Patent Application No. 197 50 023 describes a further outside door handle, the handle of which is designed as a pull-type hoop which can pivot about an essentially vertical pivot axis. The handle is coupled to a switching component, which is arranged in the interior of the vehicle door, in such a manner that a pressure actuation of the handle actuates the switching component. The actuated switching component generates a switching signal which in turn initializes an identification process. If a positive access authorization is established, the lock is unlocked and the lock can then be opened by a pull-type actuation of the handle.

It is an object of the present invention to provide an outside door handle having increased operating convenience.

SUMMARY

The above and other beneficial objects of the present invention are achieved by providing an outside door handle as described herein.

The present invention is based on the general concept of configuring the switching component in such a manner and of arranging it on or in the handle in such a manner that, when a correct opening actuation is performed, the handle generates the switching signal even before the handle pivots out of a starting position. This configuration enables the person who would like to actuate the handle to act in a conventional, customary manner on the handle without special manipulations for actuating particular switching components having to be taken into consideration in the process. The coupling provided according to the present invention between the handle and switching component enables the actuation of the switching component to take place automatically and without being noticed by the person acting on the handle. This accordingly results in relatively great operating convenience for the door outside handle according to the present invention, in which case at the same time complex measures, such as contactless sensors, etc., are not required.

To allow the switching component to be able to generate the switching signal before the handle pivots, the switching component response threshold is selected to be at such a low level that it is below a restoring force which counteracts the opening actuation of the handle and with which the handle is prestressed into its starting position. Accordingly, an opening force counteracting the restoring force automatically causes the switching component to respond before the handle moves.

While it is basically immaterial for the present invention as to where the switching component is arranged, in the case of an example embodiment the switching component may be integrated into the handle. This construction enables a play-free automatic coupling to be realized in a particularly simple manner.

In an example embodiment, the handle may have a base part on which the restoring force acts, and an actuating part attached moveably thereto, the actuating part being arranged on the outside of the base part so that an opening force which acts in a correct manner on the handle is transmitted from the actuating part to the base part, and the switching component being arranged between the base part and actuating part in such a manner that it responds when there is a relative movement between the base part and actuating part. This actuating part may be positioned in a simple manner at an ergonomically favorable position, with the result that the actuating part is automatically adjusted relative to the base part when the handle is actuated correctly.

The actuating part may be prestressed by a prestressing force into an unactuated starting position, this prestressing force being smaller than the restoring force of the handle, which force acts on the base part. This construction may ensure that the switching component automatically responds before an adjusting movement of the handle.

The switching component may be configured as a pressure sensor which is situated on the outside or inside, senses pressure forces acting on it and from a threshold value generates a switching signal. This example embodiment makes possible a particularly simple structure for the outside door handle or for the hand-grip, since, at least in the case of a pressure sensor arranged on the outside, no moveable parts are required in order to actuate the pressure sensor.

In an example embodiment which is reasonably priced, the switching component may be configured as a switch or button-type switch which has two elements which are mounted moveably one on the other and are prestressed by a response force into an unactuated starting position. The switching component generates the switching signal when there is a relative adjustment of the switching component elements counter to the response force, and the two elements of the switching component are arranged so that, when there is an opening force which acts in a correct manner on the handle, the components are adjusted relative to each other counter to the response force. Switching components of this type may be produced at a reasonable cost and may be adapted to virtually any desired installation situations.

The features mentioned above and those still to be explained below may be used not only in the combination specified in each case, but also in other combinations or on their own without departing from the scope of the present invention.

DETAILED DESCRIPTION

Figure 1:
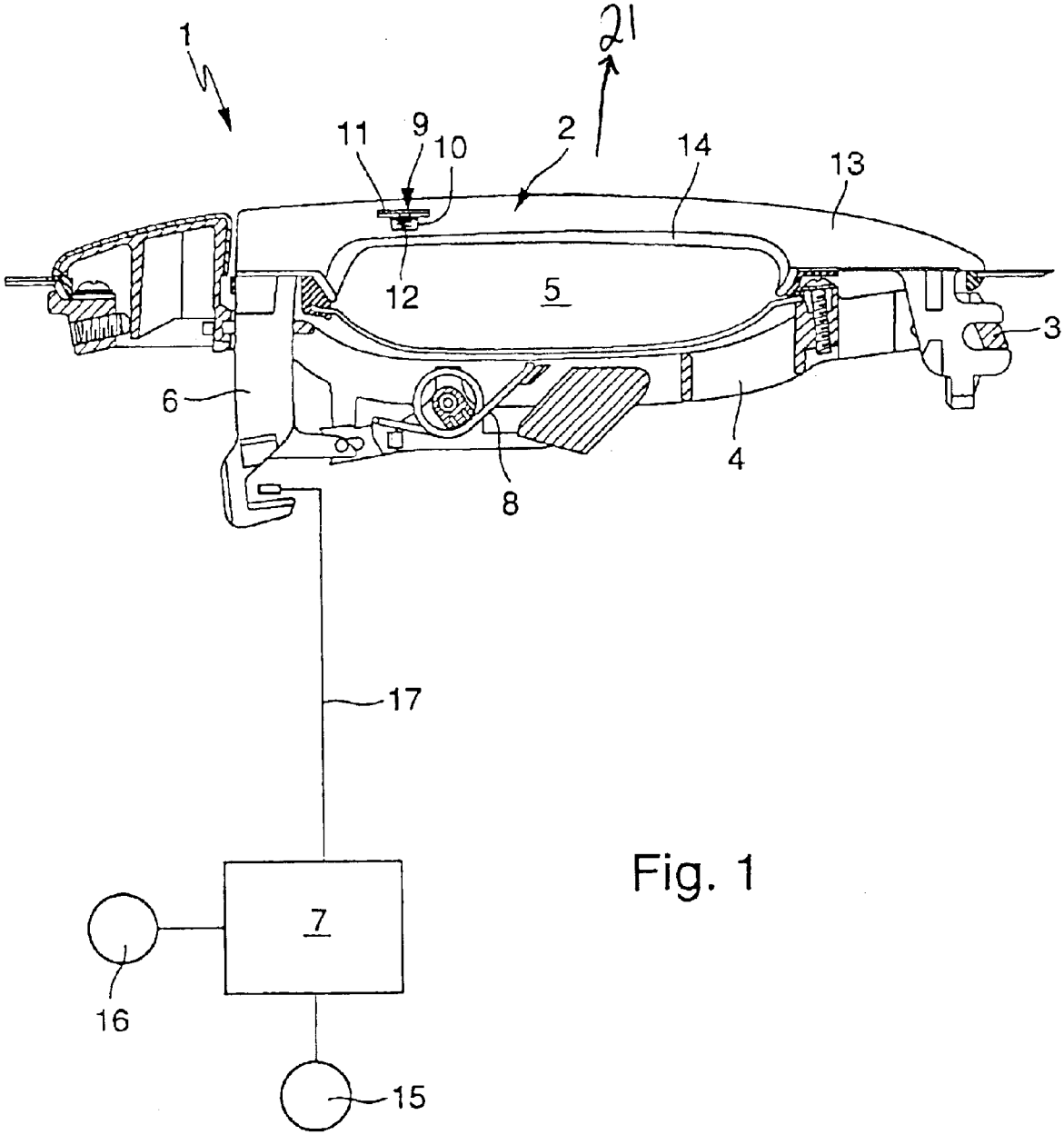
FIG. 1 is a schematic view of an outside door handle according to the present invention in a first example embodiment.

According to FIG. 1, an outside door handle 1 according to the present invention, in particular of a vehicle, has a manually actuable handle 2 which is configured in the present case as a pull-type hoop which is mounted on a support 4 of the outside door handle 1 such that the handle may pivot about an essentially vertical pivot axis 3. The handle 2 is arranged in the region of a recessed grip 5, which simplifies the manual actuation of the handle 2. At an end facing away from the pivot axis 3, the handle 2 bears a driver 6 which protrudes into the interior of a vehicle door and is coupled mechanically there to a lock 7. Furthermore, a restoring spring 8 is arranged on the support 4, the spring using the driver 6 to introduce a restoring force into the handle 2, the force prestressing the handle 2 into an unactuated starting position illustrated in FIG. 1.

The outside door handle 1 also has a switching component 9 which, in the example embodiment illustrated in FIG. 1, is integrated into the handle 2. This switching component 9 is configured here as a switch or button-type switch which, according to the schematic illustration of FIG. 1, has a first element 10 and a second element 11. The two elements 10 and 11 are mounted moveably one on the other and, via an integrated spring 12, are prestressed by a response force into an unactuated starting position.

In the example embodiment illustrated, the handle 2 is constructed in at least two parts and therefore has a base part 13 and an actuating part 14 attached moveably thereto. The driver 6 is formed on the base part 13, so that the restoring force of the restoring spring 8 acts on the base part 13. Whereas the base part 13 forms an outer side of the handle 2, which side faces away from the recessed grip 5, the actuating part 14 is formed on an inner side of the handle 2, which side faces the recessed grip 5, or the actuating part 14 forms the inner side of the handle 2.

In this case, the switching component 9 is arranged between the base part 13 and actuating part 14, the first element 10 of the switching component 9 being connected to the actuating part 14 while the second element 11 of the switching component 9 is connected to the base part 13. Accordingly, the actuating part 14 is supported on the base part 13 by the switching component 9, as a result of which the actuating part 14 is prestressed by the prestressing force of the spring 12 of the switching component 9 into a starting position, the prestressing force acting in a direction opposite opening force direction 21, which is illustrated in FIG. 1.

The door outside handle 1 according to the present invention functions as follows:

If a person would like to actuate the handle 2 in order to open it, he/she grasps the handle 2 in the region of the recessed grip 5 with his/her hand. In order to open it, the person then pulls on the handle 2 in a direction leading away from the recessed grip 5, in opening force direction 21, in which case an opening force is introduced into the handle 2. Since the actuating part 14 forms the inner side of the handle 2, or is formed on the inner side of the handle 2, force acts on the actuating part 14.

The response force of the spring 12 integrated into the switching component 9 is dimensioned to be smaller than the restoring force of the restoring spring 8. Consequently, the opening force introduced into the actuating part 14 overcomes the response force of the spring 12 in the switching component 9, with the result that the actuating part 14 moves relative to the base part 13, and hence the first element 10 moves relative to the second element 11, with the consequence that the switching component 9 may generate a corresponding switching signal and may send it to other components via suitable electric lines. The switching component 9 therefore responds before the opening force reaches the relatively large restoring force of the restoring spring 8, and so the base part 13 of the handle 2 has still not moved when the switching signal is generated. Only when the opening force—at a later time—overcomes the restoring force of the restoring spring 8 does the base part 13 or the entire handle 2 pivot about the pivot axis 3 thereof.

The switching signal of the switching component 9 may be used, for example, in order to initialize an identification process which is used to check the access authorization of the person actuating the handle 2. If a positive access authorization is established, an unlocking of the door lock 7 may be carried out. By the switching signal, the following measures may additionally or alternatively also be initiated or activated: an interior light of the vehicle may be switched on. A central locking system may open a number of locks of the vehicle by an actuating component 15. By another drive 16, for example, a servo-opening of that vehicle door on which the door outside handle 1 is formed may be activated. A mechanical coupling 17, which is formed between the driver 6 and the lock 7 illustrated in FIG. 1, is then only used as a redundant active connection between the door outside handle 1 and lock 7, in order to be able to open the vehicle door should the drive 16 fail. The functions which are listed above and which may be actuated, activated or initiated by the switching signal merely constitute a list of examples and hence basically any desired function may be switched using the switching signal of the switching component 9.

Figure 2:
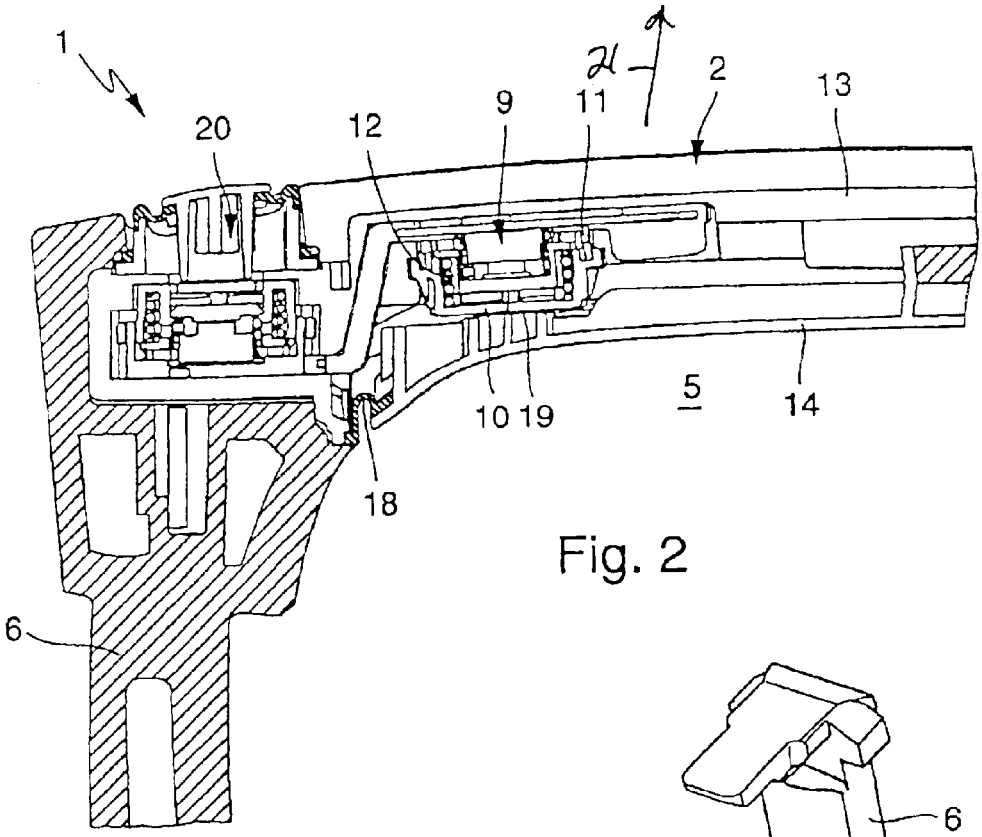
FIG. 2 is a schematic detail view of an outside door handle according to the present invention in a different example embodiment.

According to FIG. 2, in another example embodiment of the outside door handle 1 according to the present invention, the actuating part 14 may be mounted on the base part 13 in a manner such that it may be adjusted via a flexible membrane 18. In this example embodiment, the actuating part 14 is supported on the base part 13 via the switching component 9. By way of example, the second element 11 of the switching component 9 is connected fixedly to the base part 13, while the first element 10 of the switching component 9 bears against the actuating part 14 at 19 because of the prestressing of the spring 12. This arrangement enables the actuating part 14 to be prestressed by the switching component 9 or by the spring 12 thereof into the starting position which is illustrated in the Figures. Separate prestressing arrangements for the actuating part 14 may therefore be omitted. In another example embodiment, the actuating part 14 and the first element 10 may form an integral unit.

As illustrated in FIG. 2, a further switching component 20 may be integrated into the handle 2, on an outer side which faces away from the recessed grip 5, which switching component may be actuated in a conventional manner by a special manual movement.

Figure 3:
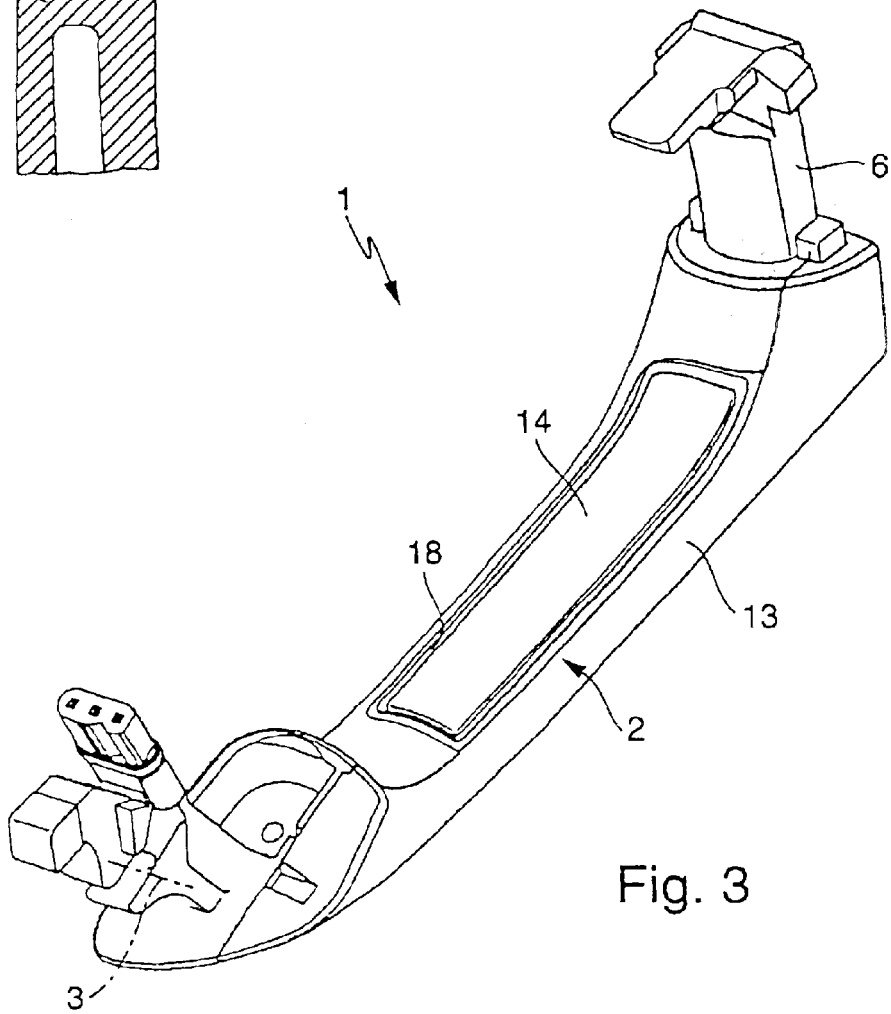
FIG. 3 is a schematic perspective view of a handle of the outside door handle illustrated in FIG. 2.

FIG. 3 is a perspective view of the inner side of the handle 2 from which it may be seen that the actuating part 14 is virtually embedded into the base part 13 in a manner integrated in terms of shape, on the inner side of the handle 2. In particular, the actuating part 14 may be arranged on the inner side of the handle 2 in a recessed manner in the outer contour of the base part 13.

The adjusting distance by which the actuating part 14 may have to be adjusted relative to the base part 13 in the direction of the opening force in order to bring about a response of the switching component 9 may be selected to be relatively small. In particular, this adjusting distance is configured to be significantly smaller than the adjusting distance of the entire handle 2 during opening of the door lock. By the arrangement according to the present invention, the convenience when opening the door lock assigned to the outside door handle 1 may be improved.

Although in the example embodiment illustrated the switching component 9 is configured as a button-type switch or switch, in which moveable parts may have to be moved in order for the switching component 9 to respond, use may also be made of a switching component which is configured as a sensor and in which no moveable parts may have to be moved relative to one another in order to cause the switching component to respond.

What is claimed is:

1. An outside door handle, comprising:

a handle; and a switching component coupled to the handle and configured so that when there is an opening force that acts in a correct manner on the handle in order to open the handle, the switching component automatically responds and generates a switching signal, a response threshold of the switching component selected to be at such a low level that the switching component responds before the opening force overcomes a restoring force counteracting the opening force and prestressing the handle into an unactuated starting position;

wherein the switching component includes one of a switch and button-switch which includes two elements mounted moveably one on another and are prestressed by a response force into the unactuated starting position, the switching component configured to generate the switching signal when there is a relative adjustment of the two elements counter to the response force, the two elements arranged so that, when the opening force acts in the correct manner on the handle, the elements are adjusted relative to each other counter to the response force.

2. The outside door handle according to claim 1, wherein the handle includes a base part on which the restoring force acts and an actuating part attached moveably thereto, the actuating part arranged on an outside of the base part and configured so that the opening force which acts in the correct manner on the handle is transmitted from the actuating part to the base part, the switching component arranged between the base part and the actuating part and configured so that the switching component responds when there is a relative movement between the base part and actuating part; and wherein a first one of the two elements of the switching component is supported on a base part of the handle and a second one of the two elements of the switching component is supported on the actuating part of the handle.

3. A door handle, comprising:

a handle adapted to move from an unactuated position to an actuated position when an opening force greater than a minimum threshold is applied to the handle in an opening direction, a restoring force counteracting the opening force and prestressing the handle into the unactuated starting position; and a switching component coupled to the handle and configured to generate a switching signal when an opening force greater than a response threshold is applied to the handle in an opening direction, the response threshold being less than the minimum threshold and being less than the restoring force;

wherein the switching component includes two elements moveably coupled and prestressed by a further response force into a further unactuated starting position, the switching component configured to generate the switching signal when the opening force acts in the opening direction on the handle.

* * * * *